United States Patent [19]

Torbert et al.

[11] Patent Number: 4,918,870

[45] Date of Patent: Apr. 24, 1990

[54] FLOATING SUBCARRIERS FOR WAFER POLISHING APPARATUS

[75] Inventors: Walter Torbert, Newark; Kenneth C. Struven, San Carlos; Robert E. Lorenzini, Atherton; Anthony C. Bonora, Menlo Park, all of Calif.

[73] Assignee: Siltec Corporation, Menlo Park, Calif.

[21] Appl. No.: 864,282

[22] Filed: May 16, 1986

[51] Int. Cl.[5] ..... B24B 37/04

[52] U.S. Cl. ..... 51/131.3; 51/216 T; 51/237 R

[58] Field of Search ..... 51/131.1, 131.2, 131.3, 51/131.4, 131.5, 235, 216 R, 237 R, 216 LP, 216 T, 105 LG, 106 R, 106 LG, 132, 133, 134, 120

[56] References Cited

U.S. PATENT DOCUMENTS

| | | | |
|---|---|---|---|
| 3,708,921 | 1/1973 | Cronkhite et al. | 51/131.4 |
| 3,833,230 | 9/1974 | Noll | 51/235 |
| 4,593,495 | 6/1986 | Kawakami et al. | 51/118 |

FOREIGN PATENT DOCUMENTS

| | | | |
|---|---|---|---|
| 2825502 | 6/1979 | Fed. Rep. of Germany | 51/131.4 |
| 0149154 | 9/1982 | Japan | 51/131.4 |
| 0743850 | 6/1980 | U.S.S.R. | 51/131.3 |
| 743850 | 6/1980 | U.S.S.R. | 51/131.3 |

*Primary Examiner*—Frederick R. Schmidt
*Assistant Examiner*—Blynn Shideler
*Attorney, Agent, or Firm*—Flehr, Hohbach, Test, Albritton & Herbert

[57] ABSTRACT

A polishing apparatus has a conventional carrier with a plurality of floating subcarriers. The benefits of single wafer polishing are achieved with the economies of multiple wafer polishing by adding the plurality of floating subcarriers to the conventional carrier. Each subcarrier has a single wafer adhered to its underside. Axial freedom is provided to duplicate the dynamics of single wafer polishing. The required axial freedom is obtained by axially loading each subcarrier via a mechanical spring or via pneumatic/hydraulic devices. In two variations, each subcarrier is also allowed autorotational freedom. In another two variations, the subcarriers are rotationally driven. In all variations, the wafers adhered to the floating subcarriers are substantially uniformly polished and the total indicated reading of the maximum deviation on the wafer surface is improved.

14 Claims, 4 Drawing Sheets

FLOATING SUBCARRIERS FOR WAFER POLISHING APPARATUS

BACKGROUND OF THE INVENTION

1. Field of the Invention

The present invention relates to an apparatus for polishing semiconductor wafers and, in particular, to floating subcarriers therefor.

2. Description of the Prior Art

Currently, silicon wafers for semiconductors are polished with machines using rigid metallic multi-wafer support chucks. Exemplary of the prior art are the apparatuses disclosed in U.S. Pat. No. 4,194,324 issued on Mar. 25, 1980, to Bonora et al. and U.S. Pat. No. 4,132,037 issued on Jan. 2, 1979, to Bonora, both of which are owned by the assignee of the present invention.

In a conventional template or so-called "insert process", the wafers are mounted in pockets on the surface of a chuck or subcarrier. The planes in the pockets in which the wafers are situated are all parallel and, more importantly, are all at the same elevation. This configuration gives rise to some problems. First, the wafers must be sorted before polishing so that all wafers being polished at a given time are approximately the same thickness. The typical range of thicknesses for wafers that are polished during any one batch process is approximately 0.0002 inches. This degree of sorting is required because the conventional so-called "one-plane polishing technique" is not able to adapt to individual thicknesses that are very different. If there is no preliminary sorting, taper can occur in the finished wafers due to uneven treatment during polishing of individual wafers with different thicknesses.

The present invention permits the adaptation of rigid chucks for improved multi-wafer polishing. Each wafer support chuck is retained in a multi-chuck carrier assembly with the vertical polishing force applied to the subcarriers by either air pressure or liquid pressure or mechanical force. Thus, each subcarrier is free to accommodate the wafers of varying thicknesses and tapers.

When air or liquid pressure is used, an elastomeric O-ring provides both a sealing function and a support function for the lateral force developed by polishing. Air or fluid pressure applied to a sealed chamber behind the subcarrier assemblies creates a downwardly directed force for polishing while the wafers are frictionally retained on the bottom side of each subcarrier. The individual subcarriers can be readily removed for surface conditioning or the whole chuck assembly can be lapped in place on a conventional lapping machine. Driven or non-driven rotation of each subcarrier on its own axis is also feasible.

On the other hand, another feature of this invention is that there may be free rotation of the floating subcarrier. This extra rotational freedom of each floating subcarrier gives the desired improved tight-tolerance flatness of the wafer. This feature is accomplished in one basic variation by using a mechanical floating subcarrier which uses a spring or other resilient means to supply a load to the wafer. This mechanical floating subcarrier is also used with spacing between the wafer edge and the associated subcarrier side wall to provide for free rotation of the wafer. However, in the variations in which there is an applied hydraulic or pneumatic force, a resilient device is interposed in the side wall in order to seal in the hydraulic fluid or the compressed air, respectively.

There are several advantages to using the present invention. First of all, production costs are lowered while wafer flatness is improved. These advantages are accomplished by allowing the individual subcarriers and, hence, the wafers to move freely during polishing and to adjust the polishing plane of the wafer faces.

Another advantage of the present invention over conventional batch-process polishers is that cycle time may be reduced and the wafer TIR may be decreased to previously unattainable levels. TIR refers to the "total indicated reading" of the maximum deviation on the wafer surface between the high point and the low point in the plane of the wafer.

Another advantage of the present invention is that consistent results are yielded and wafer thickness sorting is not required.

The accomplishment of these and other advantages will become more readily apparent from the following description of the drawings and the related discussion of the preferred embodiments.

DETAILED DESCRIPTION OF THE PREFERRED EMBODIMENTS

Before beginning a description of the details of the preferred embodiments, it is helpful to define certain terms and to set forth the generally perceived requirements of good polishing.

A silicon wafer of the type for use in forming integrated circuitry is the item that is polished. Its thickness is small when compared to its other dimensions. The carrier is the element that holds the wafers during polishing of one of its sides. The holder or head supports the carrier and imparts both control and motion thereto.

There are several requirements in order for good polishing to be accomplished. First, all points on the wafer should have more or less equal velocity relative to the polishing pad. Second, all points on the wafer should have more or less equal polishing pressure. Third, the wafer should have a motion that is not repetitious relative to the pad. Finally, economy in production should be achieved. This last requirement is obtained by using a batch process.

Figure 1:
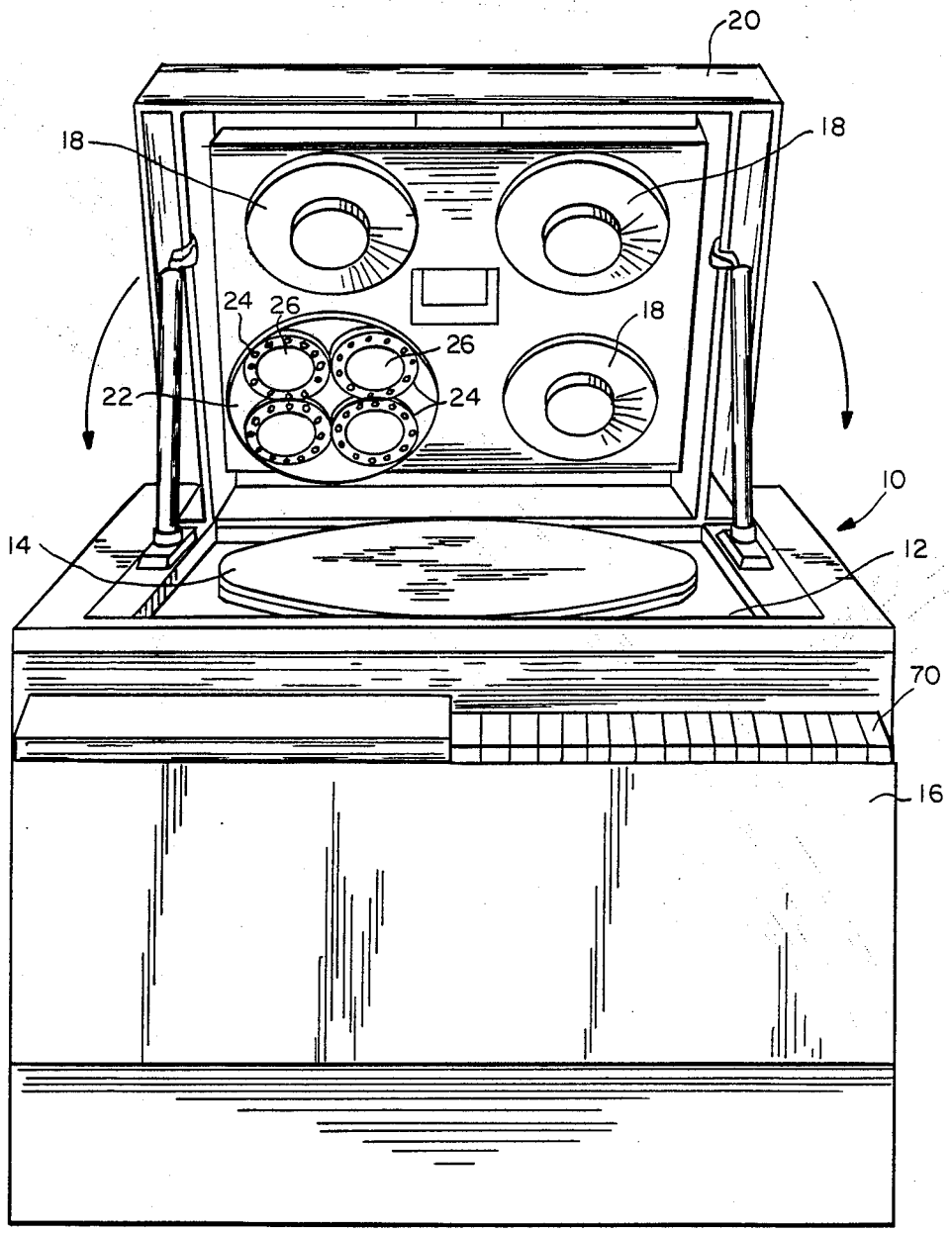
FIG. 1 shows a polishing apparatus having a single carrier mounted in place with multiple floating subcarriers secured thereto.

In FIG. 1, a polishing apparatus 10 has a platen 12 upon which there is fixedly mounted a polishing pad 14 that is rotated by a motor 16 therebeneath. In this embodiment, a plurality of holders or heads 18 are secured to the inside of a lid 20 which is closed during operation of the polishing apparatus 10. The holders 18 are rotated by a motor (not shown) mounted on top of the lid 20. A backing plate or carrier 22 is mounted to each holder 18 manually by an operator. However, in FIG. 1, only one such carrier 22 is shown. A plurality (usually three or four in number) of subcarriers 24 are mounted to each carrier 22. It will be appreciated that many configurations of heads and subcarriers are possible A wafer 26 is adhered to each subcarrier 24 by appropriate means, such as by application of a vacuum grid, by wax or by surface tension created when a small amount of water is sprayed onto the back side of each wafer 26 before insertion into its respective subcarrier 24. Adherence of the wafer 26 to the subcarrier 24 is aided by the light weight of the wafer 26.

Figure 2:
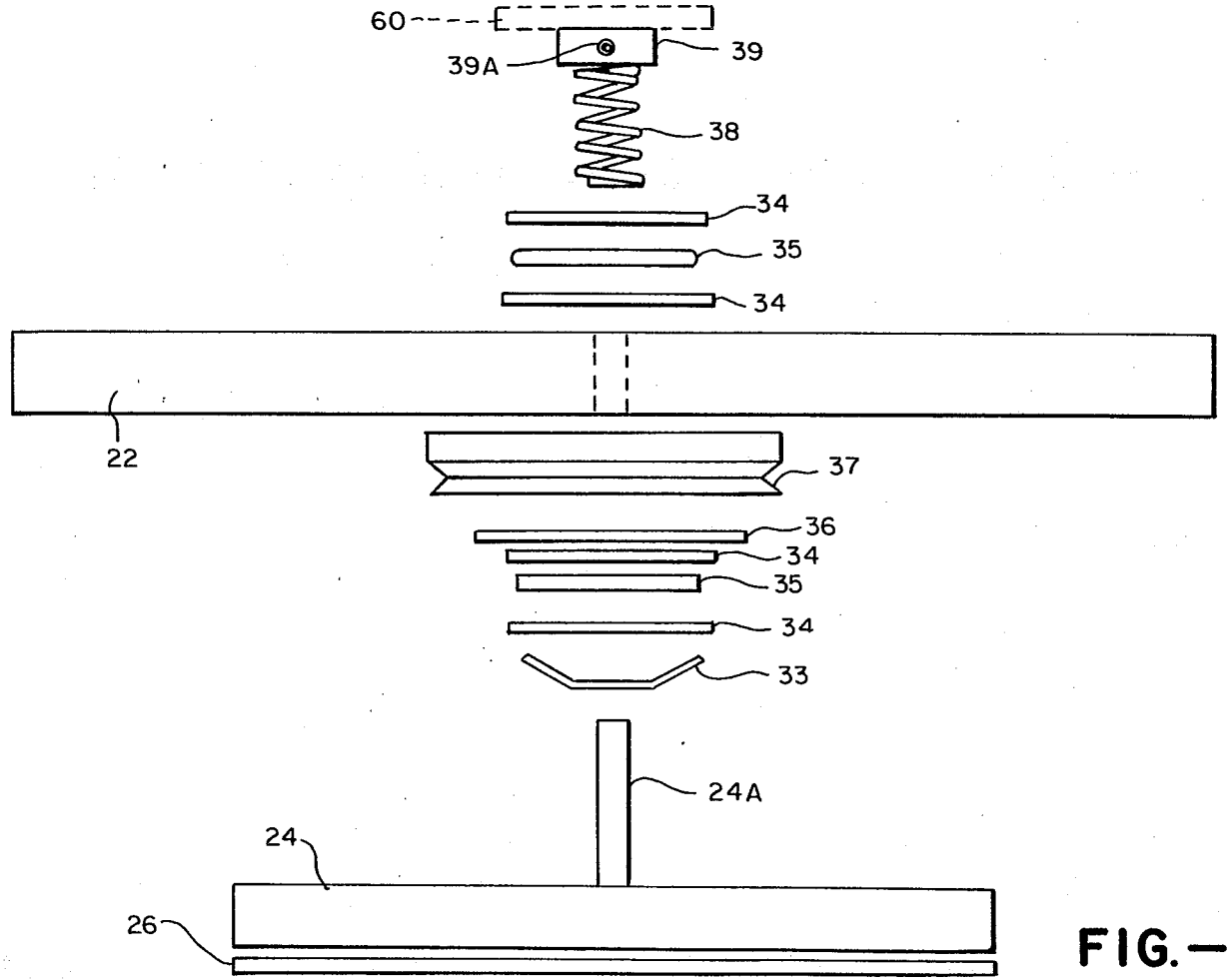
FIG. 2 shows an exploded side elevational view of a first embodiment of a floating subcarrier.

In FIG. 2, the details of the attachment of a first embodiment of the subcarrier 24 to the-carrier 22 are shown. This includes a Belleville-type spring washer 33, a plurality of hardened washers 34, two thrust washer bearings 35, a Teflon washer 36, a V-ring water seal 37 (so-called because of its V-shaped side), a compression spring 38, a shaft collar 39, and a side-load roller bearing 40 (mounted in carrier 22).

Assembly of the above-mentioned elements is now described with reference to FIG. 2. The two thrust washer bearings 35 are greased with lubricant and likewise the interface between the V-ring water seal 37 and the carrier 22 is greased. Then, the shaft collar 39 is pushed down over a pin 24A protruding from a top side of the subcarrier 24 so that all intermediate elements, particularly the spring 38, are compressed and retained between the shaft collar 39 and the top side of the subcarrier 24. Thereafter, the shaft collar 39 is tightened onto the pin 24A by a screw or other securing means 39A. Finally, the wafer 26 is wetted by spraying water thereon and is adhered to the underside of the subcarrier 24 by the surface tension of the water pressed between the wafer 26 and the underside of the subcarrier 24. Although subcarrier 24 appears laterally rigid relative to pin 24A, the opening in bearing 40 through which the pin passes actually allows ample lateral movement for practicing the present invention. The subcarrier can thus move translationally (toward or away from) and/or angularly with respect to the carrier.

Figure 3:
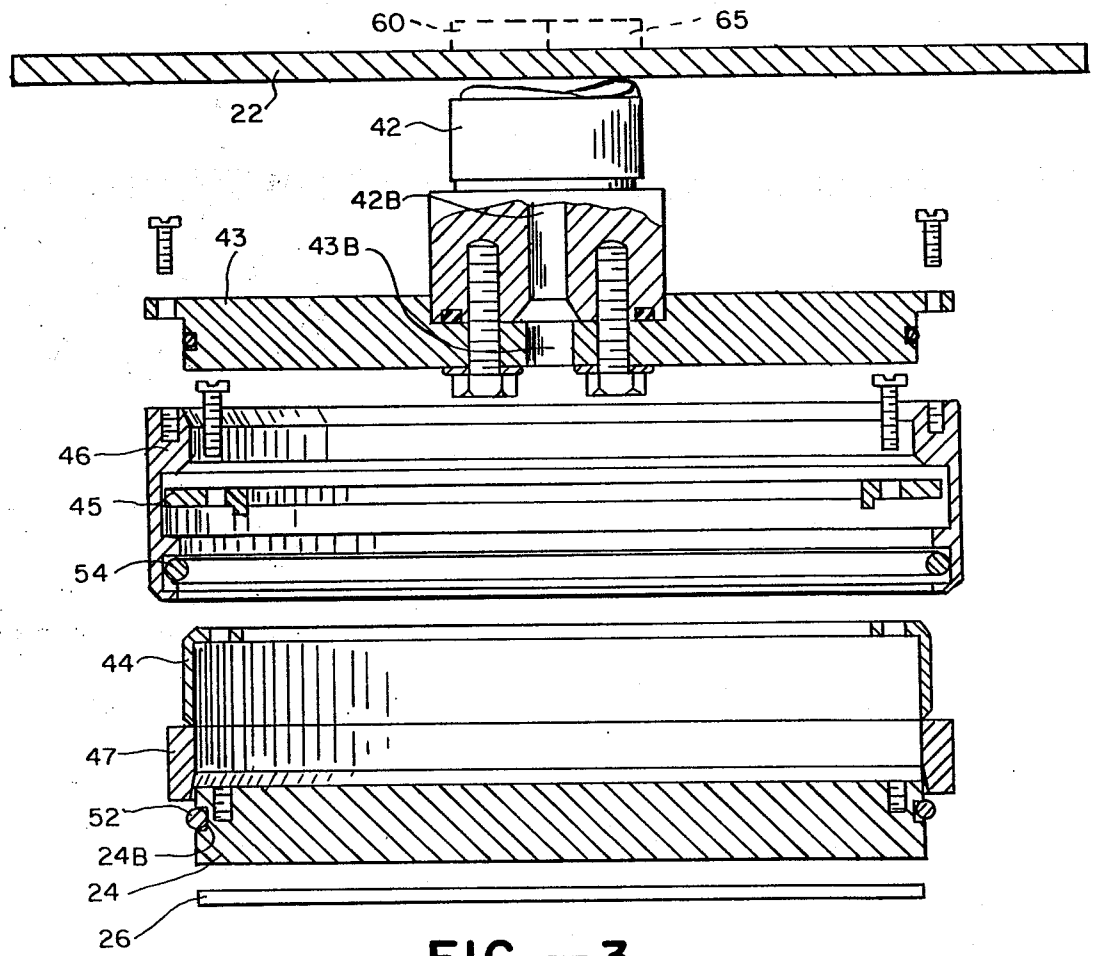
FIG. 3 shows an exploded side elevational view of a second embodiment of the floating subcarrier.

In FIG. 3, the details of the attachment of a second embodiment of the subcarrier 24 to the carrier 22 are shown. Again, the elements are identified first. There is shown a shaft 42, a head plate 43, a rim 44 which provides radial support for the wafer 26, a lift ring 45, a restrainer 46 for the subcarrier 24, a first O-ring 52, and a second O-ring 54. Wedge tool 47 is not an element of the second embodiment but is an item used for compressing the first O-ring 52 into the groove 24B and for guiding the rim 44 thereover so that the O-ring 52 is not cut when the rim 44 descends over the subcarrier 24 during assembly Basically, the assembly of the above-mentioned elements is similar to the assembly of the first embodiment in that the various elements are stacked, telescoped, and secured together in the order shown in FIG. 3 with care being taken to insure that the O-ring 52 is not cut during such assembly.

The subcarrier 24 in the second embodiment shown in FIG. 3 is retained mechanically to the carrier 22 subject to the application from a source 65 of either pressurized fluid or air through bores 42B and 43B which extend through centers of the shaft 42 and the head plate 43, respectively. The result in this second embodiment is the same as in the first embodiment, i.e. that the subcarrier 24 is able to "float" with the wafer 26 adhered thereto for polishing purposes. That is, the subcarrier has both angular and translational freedom of movement relative to the carrier.

Figure 4:
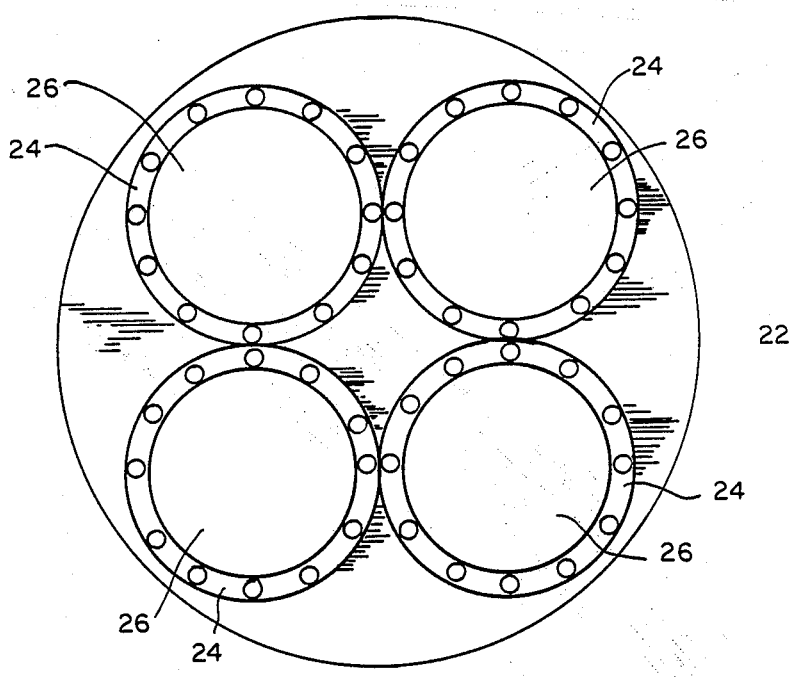
FIG. 4 shows a bottom plan view of a first embodiment of a single carrier mounted with four floating subcarriers secured thereto.
Figure 5:
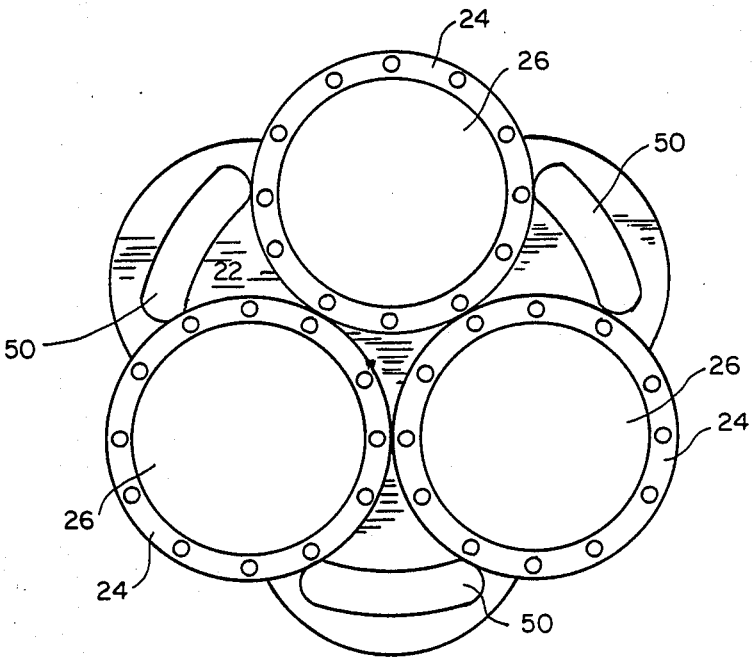
FIG. 5 shows a bottom plan view of a second embodiment of a single carrier mounted with three floating subcarriers and intermediate handles for facilitating lifting and placing of the entire carrier chuck assembly into the polishing apparatus shown in FIG. 1.

FIGS. 4 and 5 are close-up bottom plan views of the carrier assembly shown mounted in position in FIG. 1. In FIG. 4, each wafer 26 is adhered to the underside of a subcarrier 24 which is, in turn, secured as shown in FIGS. 2 and 3 to the carrier 22. In FIG. 5, each wafer 26 is likewise adhered to the underside of a subcarrier 24 which is then secured to the carrier 22. The embodiment shown in FIG. 5 has handles 50 formed in the carrier 22 so that each carrier 22 may be easily transported and mounted in place on the selected holder 18 shown in FIG. 1 illustrating the polishing apparatus 10 generally.

There are four basic variations of the floating carrier head assembly. First, as shown in FIG. 3, polishing force is applied through either hydraulic or pneumatic pressure on the back side of each subcarrier 24 with free revolution or so-called "auto-rotation" of the subcarrier 24 with the wafer 26 adhered thereto.

Second, as also shown in FIG. 3, polishing force is applied through either hydraulic or pneumatic pressure from the source 65 on the back side of the subcarrier 24 which is driven by rotation caused by the optional provision of a motor 60.

Third, as shown in FIG. 2, polishing force is applied mechanically through the spring washer 33 with auto-rotation of the subcarrier 24 with the wafer 26 adhered thereto.

Fourth, as also shown in FIG. 2, polishing force may be applied by mechanical pressure through the spring washer 33 to the back side of each subcarrier 24 which is driven by rotation caused by the optional provision of a motor 60. Motor 60 is coupled to subcarrier 24 to effectively avoid interfering with lateral movement of pin 24A.

In regard to the first and third basic variations outlined above, the concept of auto-rotation of the subcarriers 24 is simple. The wafers 26 are carried in subcarriers 24 that are allowed to revolve freely. Thus, each subcarrier 24 is driven by the dynamic forces which it experiences during the polishing process. In addition, the subcarriers 24 shown in FIG. 1 have the capability to change their polishing plane orientation with respect to the polishing apparatus 10 in general and the polishing pad 14 in particular.

In regard to all four basic variations of the present invention, the individual subcarriers 24 can adapt to the individual wafers 26 which they are carrying. In essence, the subcarriers 24 "float" to allow the wafers 26 to seek the most desirable plane that is dictated by the polishing interface formed between the bottom surface of the wafer 26 and the top surface of the polishing pad 14. This technique theoretically allows an almost perfect alignment at the polishing interface which produces, flat wafers 26 with a reduced, which typically has been found to be in the range of 1.5 to 3.0 microns.

The typical polished wafer 26 that is produced on a floating subcarrier 24 of the present invention will not exhibit as much asymmetry as a wafer produced using a standard polishing carrier. For example, it has been determined by observation that the standard prior art polishing batch processes, referred to above as template and insert processes, sometimes allow the wafers to revolve in their respective pockets in the subcarriers 24 and sometimes do not. Consequently, these prior art batch processes result in inconsistencies and variations in the finished wafers 26.

Conversely, the present invention allows the individual subcarriers 24 to revolve during the polishing process. In fact, during experiments where the speed of revolution of the auto-rotating subcarriers 24 for the first and third basic variations was measured, it was determined that the subcarriers 24 revolve at an angular velocity substantially equal to that of the polishing pad 14 and the holders 18. The polishing pad 14 is used with the polishing media or slurry applied thereon to polish the wafers 26. In one experiment, the actual angular velocity of the subcarriers 24, relative to the carriers 22, measured during a polishing operation was 64 revolutions per minute (rpm) which was the same rpm measured for the holders 18 and the polishing pad 14 during the same polishing operation.

A typical polishing operation will now be described. First of all, either the first embodiment of FIG. 2 or the second embodiment of FIG. 3 is assembled so that a selected plurality of subcarriers 24 is attached to a common carrier 22, as shown in either FIG. 4 or FIG. 5. The subcarrier 24 may be either auto-rotating or driven by the motor 60 in accordance with one of the four basic variations outlined above. The underside of each subcarrier 24 is then prepared for receiving a single wafer 26 to be polished. Such preparation may merely involve the wetting of the underside of each subcarrier 24 so that each light weight wafer 26 is retained thereto solely by the water surface tension therebetween. Thereafter, each carrier 22, as shown in FIGS. 4 and 5, is taken and is mounted, as shown in FIG. 1, on a selected holder 18 on an underside of the lid 20. After the lid 20 is locked down, control panel 70 is manipulated by an operator to start the motor 16 and thereby to rotate the platen 12 to which the pad 14 is adhered. Simultaneously, the motor (not shown) on top of the lid 20 for rotating the holders 18 is started and the holders are vertically activated (lowered) to force the wafers against the pad. If either the first or third basic variation is used so that the subcarriers 24 auto-rotate, then nothing further needs to be done until the polishing apparatus 10 signals that the polishing cycle is completed. However, if either the second or fourth basic variation is used, it is necessary for the operator to turn on the motor 60 so that the subcarriers 24 will be driven rotationally. For all four basic variations, when the polishing cycle is completed, both the rotation of the polishing pad 14 and the rotation of the holders 18 will cease. Upon unlocking and opening the lid 20, the operator will remove the polished wafers 26 from the subcarriers 24. If another batch of wafers 26 is then to be polished, the operator need only prepare each subcarrier 24 for the adherence of a wafer 26. It is unnecessary to remove the carriers 22 from the holders 18 and it is also unnecessary to take apart the floating subcarrier assemblies.

Other features of the subcarriers 24 should also be discussed. Each subcarrier 24 is effectively a base that carries the wafer 26 during polishing by providing a very stable mechanical platform. Each subcarrier 24 is preferably made of aluminum and is about five-eighths inch thick for a wafer 26 which has a six-inch diameter. For a wafer 26 which has a five-inch diameter, each subcarrier 24 is about one-half inch thick. Other materials such as stainless steel or quartz may also be used for subcarrier 24. Through calculations and empirical data, these design parameters have been found to provide sufficient integrity to accomplish the fine degree of wafer flatness required.

Another feature that should be emphasized is that each-subcarrier 24 is individually suspended in the third and fourth basic variations—always when there are more than three subcarriers 24, as shown in FIG. 4, and sometimes when there are only three subcarriers 24, as shown in FIG. 5. This individual suspension is accomplished by the spring washer 33 shown in FIG. 2 which is compressed during polishing to a suitable "working height". This so-called "working height" is the height at which the spring washer 33 is compressed during a greater percentage of its total travel. However, the spring washer 33 is by no means completely flattened out. Typically, the spring washer 33 travels a distance of about 0.006 inch from an uncompressed state to its working height. This degree of travel allows any slight wafer thickness differences to be compensated during polishing. Thus, a slightly thicker or thinner wafer 26 is treated in the same manner as the other wafers 26 that are being polished in the same batch.

If the subcarriers 24 were rigidly mounted without the benefit of the compressible spring washer 33 and the compression spring 38, the problem of unequal polishing of the wafers 26 would still be encountered in the third and fourth basic variations of the present invention. Fortunately, this problem does not occur due to the ability of the subcarriers 24 to be individually suspended. As may be expected, this ability to be individually suspended becomes more important when the number of subcarriers 24 is increased, as in the embodiment which uses four subcarriers 24 in FIG. 4.

On the other hand, the three subcarriers 24 shown in the embodiment of FIG. 5 tend to distribute the polishing forces more evenly, particularly in the case of large subcarriers 24, for example, those with six-inch diameters. This fact should be recognized because it is known that a tripod arrangement is more stable than a quadripod arrangement. Thus, the embodiment shown in FIG. 4 with four subcarriers 24 having five-inch diameters in a quadripod arrangement is not so perfectly balanced as the tripod arrangement of FIG. 5. As exemplified by a four-legged table which does not sit evenly on a perfectly flat floor, the situation for the four subcarriers 24 of FIG. 4 is similar. In a quadripod arrangement , at least one of the subcarriers 24 has the distinct possibility of having its wafers 26 less polished during the polishing process. However, with the present invention, this possibility of inferior polishing of one or more wafers 26 is overcome by the use of the compression spring 38 and the spring washer 33 to suspend the individual subcarriers 24.

Another feature of the present invention is the ride of the subcarriers 24 on very low friction bearings. One bearing (not shown) carries the normal loading applied down through the subcarriers 24 from the holders 18 in the polishing apparatus 10 shown in FIG. 1. Low friction bearing 40 carries side loading which occurs because of the relative lateral motions produced in the polishing process. Because the holders 18 and the polishing pad 14 rotate with the subcarriers 24 therebetween, the side loading forces to which the subcarriers 24 are subjected are dependent upon the coefficient of friction between the polishing pad 14 and the wafers 26 as well as upon the normal force which is applied downwardly during the polishing cycle. Thus, it is important that the bearings used in the present invention are of the low friction type.

In conclusion, the invention could be summarized as an assembly for polishing at least one thin wafer 26 having a surface with height deviations. The assembly comprises a rigid plate carrier 22 having a first face and at least one subcarrier 24 mounted on the first face of the carrier 22. The subcarrier 24 has one face and an opposite face. The wafer 26 is adhered to the one face of the subcarrier 24 for polishing. There is also a device for applying treating force to the wafer 26 through pressure exerted onto the opposite face of the subcarrier 24 while simultaneously allowing the subcarrier 24 to float on its one face. The device for applying treating force includes either mechanical elements or an hydraulic system or a pneumatic system. Optionally, a motor 60 may be used to cause rotation of the subcarrier 24. In all variations, the wafer 26 which is adhered to the subcarrier 24 is uniformly polished across its surface so that the height deviations thereon are reduced.

The foregoing preferred embodiments are considered illustrative only. Numerous other modifications will readily occur to those persons skilled in the pertinent technology. Consequently, the disclosed invention is not limited to the exact construction shown and described but is defined by the claims appended hereto.

What is claimed is:

1. An assembly for polishing one of two generally parallel opposed surfaces of a thin wafer having height deviations in an area of said one surface, said assembly comprising:

a. a main carrier having a first face;

b. at least one subcarrying means mounted on said first face of said main carrier for independent angular movement relative to said main carrier, each subcarrying means for carrying a single wafer and having a first side and a second side, said first side having a face area conforming in shape to an area of said opposed wafer surface which is directly opposed to said area of said one wafer surface having said height deviations, to provide support from said subcarrying means through said wafer for said area of said one wafer surface and resist deformation thereof during polishing; and c. means for applying polishing force to a wafer adhered to said subcarrying means through pressure exerted onto said second side thereof while simultaneously allowing said subcarrying means to move angularly relative to said main carrier, whereby said one surface of said wafer is uniformly polished with said area of said one wafer surface supported so that the height deviations therein are substantially eliminated.

2. The assembly according to claim 1, wherein said means for applying polishing force includes mechanical elements.

3. The assembly according to claim 2, wherein: said mechanical elements include resilient means.

4. The assembly according to claim 1, wherein: said means for applying polishing force includes a hydraulic system.

5. The assembly according to claim 4, wherein: said hydraulic system includes a source of a pressurized fluid and bore means for delivering the pressurized fluid to said second side of said subcarrying means.

6. The assembly according to claim 1, wherein: said means for applying polishing force includes a pneumatic system.

7. The assembly according to claim 6, wherein: said pneumatic system includes a source of pressurized fluid and bore means for applying polishing force on said second side of said subcarrying means.

8. The assembly according to claim 1, further comprising:

means for causing rotation of said subcarrying means.

9. The assembly according to claim 8, wherein: said rotation-causing means is a motor.

10. The assembly according to any of claims 2–7, further comprising:

means for causing rotation of said subcarrying means.

11. The assembly according to claim 1, wherein there are at least two of said subcarrying means for carrying at least one wafer respectively, adapted to be mounted on said first face of said main carrier, each of said subcarrying means being mounted on said main carrier to move angularly relative to said main carrier independently of the other.

12. An assembly as in claim 1 wherein said means for mounting releaseably holds said subcarrier and enables independent angular and translational movement of said subcarrier relative to said main carrier while so held.

13. An assembly for polishing one of two generally parallel opposed surfaces of each of at least two thin wafers, each of which has height deviations in an area of said one surface, said assembly comprising:

a. a main carrier having a first face;

b. at least two subcarrying means mounted independently on the first face of said main carrier for independent angular movement relative to each other and to said main carrier and carrying a single wafer respectively, each of said subcarrying means having a first side and a second side, said first side having a face area conforming in shape to an area of said opposed wafer surface which is directly opposed to said area of said one wafer surface having said height deviations, to provide support from said subcarrying means through said wafer for said area of said one wafer surface and resist deformation thereof during polishing; and c. means for applying polishing force to a wafer adhered to said subcarrying means through pressure exerted onto said second side of the associated carrier while simultaneously allowing each of said subcarrying means to move angularly relative to said main carrier independently of one another, whereby said one surface of each of said wafers is uniformly polished with said area supported so that the height deviations therein are substantially eliminated.

14. An assembly for polishing one of two generally parallel opposed surfaces of each of a plurality of thin wafers, each of which has height deviations in an area of said one surface, comprising:

a main carrier having a first face;

a plurality of subcarriers, each of which has a first side and a second side, said first side having a face area conforming in shape to an area of said opposed wafer surfaces of each of said wafers which is directly opposed to said area of said one wafer surface of each having said height deviations to provide support from said respective subcarrying means through said wafers for said area of said one wafer surface during polishing and resist deformation thereof;

means for independently suspending each of said subcarriers from said main carrier and for providing independent angular movement of said subcarriers with respect to said main carrier and with respect to one another; and means for providing an polishing pressure said subcarriers while simultaneously allowing said subcarriers to move angularly relative to said main carrier independently whereby said one surface of each wafer is uniformly polished with said area supported to substantially eliminate height deviations therein.

* * * * *